US009207042B1

(12) United States Patent
Erskine

(10) Patent No.: US 9,207,042 B1
(45) Date of Patent: Dec. 8, 2015

(54) REMOVABLE DEVICE FOR FIREARM WITH RECIPROCATING FINGER HOLD

(71) Applicant: James Randall Erskine, Canmer, KY (US)

(72) Inventor: James Randall Erskine, Canmer, KY (US)

( * ) Notice: Subject to any disclaimer, the term of this patent is extended or adjusted under 35 U.S.C. 154(b) by 246 days.

(21) Appl. No.: 14/075,117

(22) Filed: Nov. 8, 2013

Related U.S. Application Data

(60) Provisional application No. 61/724,355, filed on Nov. 9, 2012.

(51) Int. Cl.
*F41A 5/00* (2006.01)
*F41C 27/00* (2006.01)
*F41C 23/20* (2006.01)

(52) U.S. Cl.
CPC ..... *F41C 27/00* (2013.01); *F41C 23/20* (2013.01)

(58) Field of Classification Search
CPC ..... F41C 23/20; F41C 27/00
USPC ..... 89/132, 139; 42/90
See application file for complete search history.

(56) References Cited

U.S. PATENT DOCUMENTS 319,595 A 6/1885 Maxim
554,068 A 2/1896 Kimball
1,456,482 A * 5/1923 Berthier ..... F41A 3/38 42/16
2,292,351 A * 8/1942 Carpenter ..... F41C 23/00 42/71.01
2,441,029 A * 5/1948 Nyvall ..... F41A 3/38 89/140
2,807,113 A 9/1957 Ivy
4,512,101 A * 4/1985 Waterman, Jr. ..... F41C 23/18 42/71.01
4,625,706 A * 12/1986 Turner, Jr. ..... F42B 6/00 124/22
5,179,245 A * 1/1993 Straka ..... F41A 3/72 42/71.01
6,101,918 A * 8/2000 Akins ..... F41A 19/03 89/129.01
6,925,744 B2 8/2005 Kincel
7,823,313 B2 * 11/2010 Faifer ..... F41C 23/06 42/1.06
8,176,835 B1 * 5/2012 Cottle ..... F41A 19/11 42/69.01
8,191,299 B2 * 6/2012 Faifer ..... F41C 23/06 29/592

* cited by examiner

*Primary Examiner* — Samir Abdosh
(74) *Attorney, Agent, or Firm* — Middleton Reutlinger

(57) ABSTRACT

Apparatus and methods relating to a device for increasing the firing rate of a firearm that may be retrofit to an existing firearm. The device includes an anchor mechanism affixed to a slidable butt stock of the firearm and also includes a finger hold connected to the anchor mechanism that translates forward to remove a user's finger from the trigger and translates backward to allow the user's finger to activate the trigger and fire the firearm.

19 Claims, 6 Drawing Sheets

REMOVABLE DEVICE FOR FIREARM WITH RECIPROCATING FINGER HOLD

CROSS-REFERENCE TO RELATED APPLICATIONS

This application claims the benefit of U.S. Provisional Patent Application Ser. No. 61/724,355, filed Nov. 9, 2012, and entitled "Device for Increasing the Firing Rate of a Semi-Automatic Firearm".

TECHNICAL FIELD

Generally, a device is taught that may attach to an existing firearm to increase the firing rate of that firearm. More specifically, present embodiments relate to a device having a connection rod affixed to a sliding butt stock, wherein the device has a finger hold that reciprocates with the motion of the butt stock and may cause rapid reciprocating engagement and disengagement of a user's trigger finger with a trigger of a fire arm.

BACKGROUND

Semi-automatic firearms are limited to firing one round per trigger pull, whereas fully automatic firearms may fire multiple rounds per trigger pull. Thus, the firing rate of semi-automatic firearms may be significantly less than the firing rate of fully-automatic firearms. The availability of fully automatic weapons, however, is often limited by laws restricting the use of such firearms. Users may wish to achieve an increased fire rate while also avoiding the limitations and penalties associated with owning or possessing fully automatic firearms.

"Bump firing" is one method that has been developed to increase the firing rate of a semi-automatic firearm. Traditionally, bump firing uses two opposing forces, a forward (down range) force applied by a user and a backward (recoil) force created when a round of ammunition has been fired from the chamber of the firearm. With bump firing, these forces may be manipulated to increase the firing rate of a semi-automatic firearm. The "belt loop method" is one example of bump firing. Using the belt loop method, a user may aim the firearm downrange, applying a force to a rifle guard, grip, or similar structure of the firearm with the user's non-trigger hand. At the same time, the user may hook one finger of his or her trigger hand through a belt loop on his or her hip while also looping a different finger of the trigger hand through the trigger housing of the firearm. As the user applies forward force with the non-trigger hand, the trigger finger applies pressure to the trigger, which causes firing of a single round with a semi-automatic firearm. The recoil from this single round pushes the gun backwards, allowing the firing mechanism to reset and a new round to be loaded into the chamber. The backward recoil motion is restrained by the finger placed through the belt loop and the forward force applied by the non-trigger hand causes rapid firing of the second or subsequent rounds, which may be similar to the firing rate of a fully automatic firearm.

Traditional bump firing methods, however, often have drawbacks. For example, the belt loop method requires holding the firearm near the hip, which may decrease accuracy by decreasing the user's ability to aim as well as decreasing the user's ability to control recoil, increasing bullet spray. Some devices have been developed to allow bump firing while also mitigating the decrease in accuracy associated with traditional bump firing methods.

These devices, however, suffer from drawbacks of their own. For example, these devices require extensive modification of a firearm, which may include removal of the buffer tube and/or rear grip of the firearm in order to use the bump firing device. Further, these devices require a user to remove the rifle from a firing position to make adjustments to the butt stock in order to transition from a semi-automatic firing mode to a bump firing mode.

Thus, there is a need in the art for overcoming the issues of existing systems.

SUMMARY

The present disclosure is directed towards apparatus and methods for increasing the firing rate of a semi-automatic firearm. The device is, in various embodiments, designed to be a retrofit to an existing firearm. The device transfers the sliding motion of the butt stock of the existing firearm to a finger hold that is configured to repeatedly engage and disengage a user's trigger finger placed on or near the trigger of the firearm.

Generally, in one aspect, a removable device for increasing the firing rate of a firearm is provided having a connection rod and an anchor tube attachable to a butt stock of the firearm. The connection rod is removably attachable to the anchor tube and slidably retained in the anchor tube, which in turn is removably attachable to the butt stock of the firearm. The butt stock slidably engages the firearm and may slide in reciprocating fashion between a forward position and a rearward position. The connection rod is removably attachable to the anchor tube at a first end of the connection rod. The connection rod has a finger hold that is configured to be adjacent to the trigger of the firearm and to reciprocate back-and-forth relative to the trigger. The finger hold may reciprocate back-and-forth to allow reciprocating activation and de-activation of the trigger by a trigger finger. Activation allows the firearm to fire one or more rounds when the connection rod and anchor tube are attached to the butt stock and the butt stock is in the rearward position. De-activation allows the finger hold to be positioned forward of the trigger to allow removal of the trigger finger from the trigger when the connection rod and anchor tube are attached to the butt stock and the butt stock is in the forward position. Optionally, the connection rod may include a forward stop interposed between the first end of the connection rod and an oppositely disposed second end of the connection rod. The forward stop may be configured to form a mechanical stop with the firearm when the butt stock is in the forward position. In some embodiments, the forward stop is interposed between the first end of the connection rod and the finger hold. The forward stop may be configured to form a mechanical stop with a receiver plate of the firearm. The forward stop may be removably attachable to the connection rod at one or more locations on the connection rod. The finger hold may be removably attachable to the connection rod. The anchor tube may be cylindrical and/or have an annular anchor cavity for receiving the connection rod. If included, the annular anchor cavity may have a substantially continuous diameter. The connection rod may optionally reciprocate along an axis defined by a central longitudinal axis of the firearm. The connection rod may have a longitudinally extending central stem that has a forward stop and the finger hold is defined by a curved finger support that depends from the longitudinally extending central stem. The finger support may be positioned adjacent the trigger of the firearm.

Generally, in another aspect, a device for increasing the firing rate of a firearm is provided having a butt stock, a connection rod, and an anchor tube. The butt stock is slidably engageable with a buffer tube of the firearm and slidable between a forward position and a rearward position. The anchor tube is affixed to the butt stock to form a butt stock and anchor tube unit. The connection rod is removably attachable to the anchor tube at a first end of the connection rod. The connection rod having a finger hold disposed at a predetermined distance from the first end of the connection rod, which predetermined distanced is determined by the location of a trigger of the firearm. The connection rod has a second end disposed opposite the first end of the connection rod. The connection rod has a forward stop interposed between the first end of the connection rod and the second end of the connection rod. The forward stop is configured to form a mechanical stop formed by contact with a portion of the firearm when the butt stock is in the forward position, with the forward stop able to reciprocate back-and-forth relative to that portion of the firearm. The finger hold is adjacent the trigger of the firearm and to remove a user's finger from said trigger when the butt stock is in the forward position. The finger hold is also configured to allow activation of the trigger to fire one or more rounds from the firearm when the butt stock is in the rearward position. Optionally, the forward stop may be removably attachable to the connection rod at one or more locations on the connection rod. The finger hold may be removably attachable to the connection rod.

Generally, in another aspect, a device for increasing the firing rate of a semi-automatic rifle is provided having a slidable butt stock, an anchor tube and a connection rod. The slidable butt stock may reciprocate along a buffer tube of the semi-automatic rifle in such a way that the butt stock may slide back-and-forth longitudinally along the buffer tube. The anchor tube is attached to an exterior side of the butt stock so that it extends longitudinally and substantially parallel to the buffer tube. The anchor tube has an anchor cavity that is configured to accept a first end of the connection rod. The connection rod is removably attachable to the anchor tube and at least partially insertable into the anchor cavity. The connection rod extends longitudinally and substantially parallel to the longitudinal extension of the anchor tube. The connection rod and the anchor tube may be reciprocate back-and-forth with the butt stock. The connection rod has a finger hold and a forward stop. The finger hold and forward stop are located on the connection rod in such a way that when the connection rod is in a forward position the finger hold is positioned forward of the trigger of the semi-automatic rifle thus restricting a trigger finger from activating the trigger and firing the rifle. The finger hold is also located and/or configured on the connection rod in such a way that when the connection rod is in a rearward position the trigger may be activated by the trigger finger. Optionally, the forward stop may be configured to form the mechanical stop with a receiver plate of the rifle. The mechanical stop may be formed by contact between the forward stop and the receiver plate of the rifle. The forward stop may be removably attachable to the connection rod at one or more locations on the connection rod. The finger hold may be removably attachable to the connection rod.

DETAILED DESCRIPTION

Figure 1:
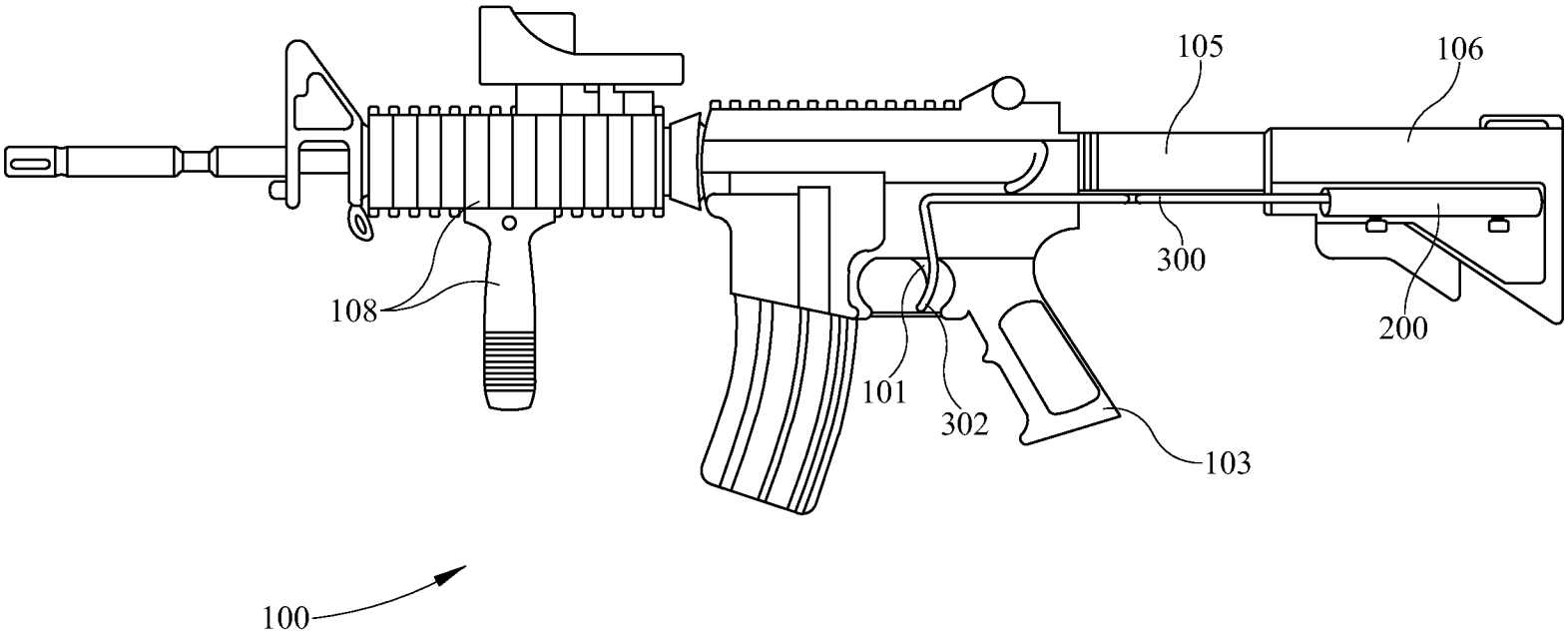
FIG. 1 is a side view of an embodiment of a firearm having a removable device with a reciprocating finger hold.

It is to be understood that the embodiments are not limited in their application to the details of construction and the arrangement of components set forth in the following description or illustrated in the drawings. Other embodiments are possible and may be practiced or carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected" and "coupled" and variations thereof herein are used broadly and encompass direct and indirect connections and couplings. In addition, the terms "connected" and "coupled" and variations thereof are not restricted to physical or mechanical connections or couplings.

Referring initially to FIGS. 1-4, an exemplary embodiment of a semi-automatic firearm 100 is shown. Firearm 100 may include a butt stock 106 that slidably engages a buffer tube 105. In this way, butt stock 106 may slide longitudinally along buffer tube 105 to allow linear motion of butt stock 106 relative to buffer tube 105 so that butt stock may, for example, slide from a forward position (nearer a trigger 101 of firearm 100) to a rearward position (further from the trigger 101 of firearm 100) in reciprocating fashion. Buffer tube 105 may be affixed to the remaining portions of firearm 105, which may collectively be referred to as the firearm housing, which may or may not include buffer tube 105. Butt stock 106 may have attached thereto an anchor tube 200 and/or a connection rod 300. Connection rod 300 may have a finger hold 302 configured to be adjacent the trigger 101 of firearm 100 when butt stock 106, anchor tube 200, and connection rod 300 are installed on and/or attached to firearm 100. In this way, as butt stock 106 slides or reciprocates back-and-forth along, and relative to, buffer tube 105, anchor tube 200, connection rod 300, and finger hold 302 similarly slide or reciprocate back and forth. Finger hold 302 can therefore be made to repeatedly slide or reciprocate forward to remove a user's trigger finger from trigger 101 and slide or reciprocate backward to allow activation of trigger 101 by the user's trigger finger. In this way, the firing rate of firearm 100 may be increased by a bump firing or similar method. The term "bump firing" as used herein generally means a method of increasing the firing rate of a semi-automatic firearm by using a first forward force applied using one hand holding a grip of the firearm and a second backward force resulting from the firing of one or more rounds from the firearm (i.e. recoil). It is understood that use of the term "bump firing" does not preclude use of similar methods or other methods that cover the same concepts, including, but not limited to, applying a forward and a backward force to achieve increased firing rate.

Butt stock 106 may have affixed thereto an anchor mechanism, such as anchor tube 200, which may be rigidly affixed thereto so that linear motion of butt stock 106 relative to the rest of firearm 100 may likewise cause linear motion of anchor tube 200 relative to the rest of firearm 100. Butt stock 106 may be provided with firearm 100 upon purchase, or as a part suitable to serve as a butt stock that may be separately purchased, made by the user, customized by the user, or otherwise provided. Butt stock 106 may be an adjustable type butt stock and/or configured to slide back and forth on buffer tube 105 by, for example, loosening or removing a locking pin 107 of butt stock 106. Sliding of butt stock 106 on buffer tube 105 may be restrained or prevented by tightening or inserting locking pin 107. It is understood that locking pin 107 is optional and not required in all embodiments.

Anchor tube 200 may be removably attached to butt stock 106, for example, by use of mounting mechanism 202. Mounting mechanism 202 may be a nut and bolt type fastener with the bolt being attached to the anchor tube (e.g., by welding or other means) and the nut being removed from the bolt, the bolt being inserted through butt stock 106, and the nut being re-secured to the bolt to retain anchor tube 200 on butt stock 106. This exemplary attachment mechanism through mounting mechanism 202 facilitates removal and attachment of anchor tube 200 for, for example, a retrofit of existing butt stock 106. It is understood that any of a variety of attachment mechanisms may be used, and attachment of anchor tube 200 to butt stock 106 is not limited to use of mounting mechanism 202 as depicted. It is further understood that, although two mounting mechanisms 202 are depicted, mounting mechanism 202 may not be required in some embodiments but, if used, any number of mounting mechanisms 202 may be used, including one.

Anchor tube 200 may be a substantially hollow tube having anchor cavity 203. Connection rod 300 may be a longitudinally extending rod with a first end 330 configured for at least partial insertion into, and/or attachment with, anchor cavity 203 and/or anchor tube 200. Anchor tube 200 may have a connection rod attachment mechanism such as anchor screws 201 to allow removable attachment of connection rod 300 to anchor tube 200. Anchor screws 201 may secure connection rod 300 to anchor tube 200 with enough retention force and/or pressure to substantially prevent relative motion between anchor tube 200 and connection rod 300 during use of firearm 100, for example, during firing. Anchor screws 201 may also provide a mechanism for removably attaching anchor tube 200 to connection rod 300 so that, for example, tightening of anchor screws 201 securely retain connection rod 300 within an anchor cavity 203 and subsequent loosening of anchor screws 201 may allow removal of connection rod 300 from anchor tube 200. In this way, connection rod 300 and/or connection rod first end 330 may slide into and/or out of anchor cavity 203 and also be retained within anchor cavity 203 and/or anchor tube 200.

Anchor screws 201, anchor tube 200, and connection rod 300 may be configured to allow repeated tightening and loosening to facilitate repeated attachment and removal of connection rod 300 from anchor tube 200. It is understood that any of a variety of attachment mechanisms may be used, and attachment of connection rod 300 to anchor tube 200 is not limited to use of anchor screws 201. It is further understood that, although two anchor screws 201 are depicted, anchor screws 201 may not be required in some embodiments but, if used, any number of anchor screws 201 may be used, including one. If used, anchor screws 201 may, for example, be threaded and/or turned by a user in a first direction to increase the length of the anchor screws 201 within the anchor cavity 203 of anchor tube 200, thereby applying force (e.g., friction) and/or pressure against connection rod 300 to hold connection rod 300 in place against an interior wall of the anchor tube 200. Continuing this example, the connection rod 300 may be released from anchor tube 200 by turning the anchor screws 201 in the opposite direction to reduce the length of the anchor screws 201 in anchor cavity 203, thereby reducing the (frictional) force and/or pressure holding connection rod 300 in place within anchor tube 200. Anchor cavity 203 may be an annular receiving area having a substantially continuous diameter over its length, although it is understood that anchor cavity 203 need not have a round cross-section and that, if anchor cavity 203 has a diameter, it need not be continuous over its length. It is understood that anchor cavity 203 may be any of a variety of cross-sectional shapes, including, but not limited to, circular, elliptical, ovular, rectangular, triangular, square, polygonal, or any other shape or combination thereof. It is further understood that anchor cavity may be any of a variety of lengths, and may extend through anchor tube 200 or only extend partially in anchor tube 200.

Although depicted as a substantially hollow cylindrical tube, it is understood that anchor tube 200 may be any of a variety of shapes, including, but not limited to, elliptical, ovular, round, rectangular, triangular, square, polygonal, or any other shape, or any combination thereof. In some embodiments, anchor tube 200 may be about 2-8 inches in length, and, in some embodiments, may be about 4-6 inches in length. It is understood that these length dimensions are merely exemplary and anchor tube 200 may be virtually any length. In some embodiments, anchor tube may have a diameter or other cross-sectional dimension of about 0.3-0.7 inches, although it is understood that this is merely an example and virtually any size anchor tube 200 may be used. Anchor tube 200 may be made from any suitable material, including, but not limited to, plastic, wood, rubber, synthetic material, metal such as, for example, steel, copper, aluminum, alloy, or any other metal or combination thereof, any other material, or any combination thereof.

Firearm 100 may have a central longitudinal axis that extends over its length. For example, firearm 100 may have a central longitudinal axis that forms an axis of its barrel and/or its buffer tube 105, and/or extends in a direction from the front or muzzle to the rear or butt stock of the firearm 100. Any or all back-and-forth reciprocating motion or sliding may be along or parallel to the longitudinal axis of firearm 100, for example, the reciprocating motion of butt stock 106, anchor tube 200, connection rod 300, and/or any components thereof, relative to trigger 101 and/or forward grip 108 may be along or parallel to the central longitudinal axis of firearm 100.

Connection rod 300 may have a finger hold 302 disposed a distance away from connection rod first end 330. For example, finger hold 302 may be at or near a second end 320 of connection rod 300, with the second end 320 being opposite first end 330. It is understood, however, that, in some embodiments, connection rod 300 may extend beyond finger hold 302 such that finger hold 302 is not at or near second end 320. Finger hold 302 may be made to reciprocate back-and-forth relative to trigger 101 repeatedly between a forward position and a rearward position. When in the forward position, finger hold 302 may be positioned forward of trigger 101 to prevent or restrain a user's trigger finger from activating trigger 101. When in the rearward position, finger hold 302 may be positioned rearward of trigger 101 so that the user's trigger finger is substantially unrestrained by finger hold 302 from activating trigger 101. For example, by way of its attachment to reciprocating connection rod 300, finger hold 302 may be made to reciprocate relative to trigger 101. Finger hold 302 may be configured and/or located on connection rod 300 to correspond to the dimensions of firearm 100 for which it is to be used, which location and/or configuration may be predetermined based on the dimensions of the given firearm 100. Connection rod 300 may have a longitudinally extending central stem portion from which finger hold 302 may depend. Finger hold 302 may be defined by a substantially curved finger support, although it is understood that finger hold 302 need not be curved or shaped as a finger support.

Finger hold 302 may be shaped in any of a variety of ways, including, for example, substantially arcuate and/or corresponding to the shape of trigger 101, which may enhance user comfort. It is understood however, that finger hold 302 need not be arcuate or curved, as it may be linear or any other shape, and it is not necessary that finger hold 302 correspond in shape to trigger 101. It is further understood that finger hold 302 may be a separate piece that may be mounted, attached, or connected to the connection rod 300 by any of a variety of attachment mechanisms (e.g., screw, bolt, snap, welded, etc.) depending on the geometry of the firearm being used. It is also understood that having a removably attachable finger hold 302 may facilitate on site modification and/or customization of the connection rod 300 and/or finger hold 302 for use with more than one specific type of firearm. Further still, it is understood that finger hold 302 may be made of any of a variety of materials and may be the same as or different than the material or materials used to construct connection rod 300.

Figure 2:
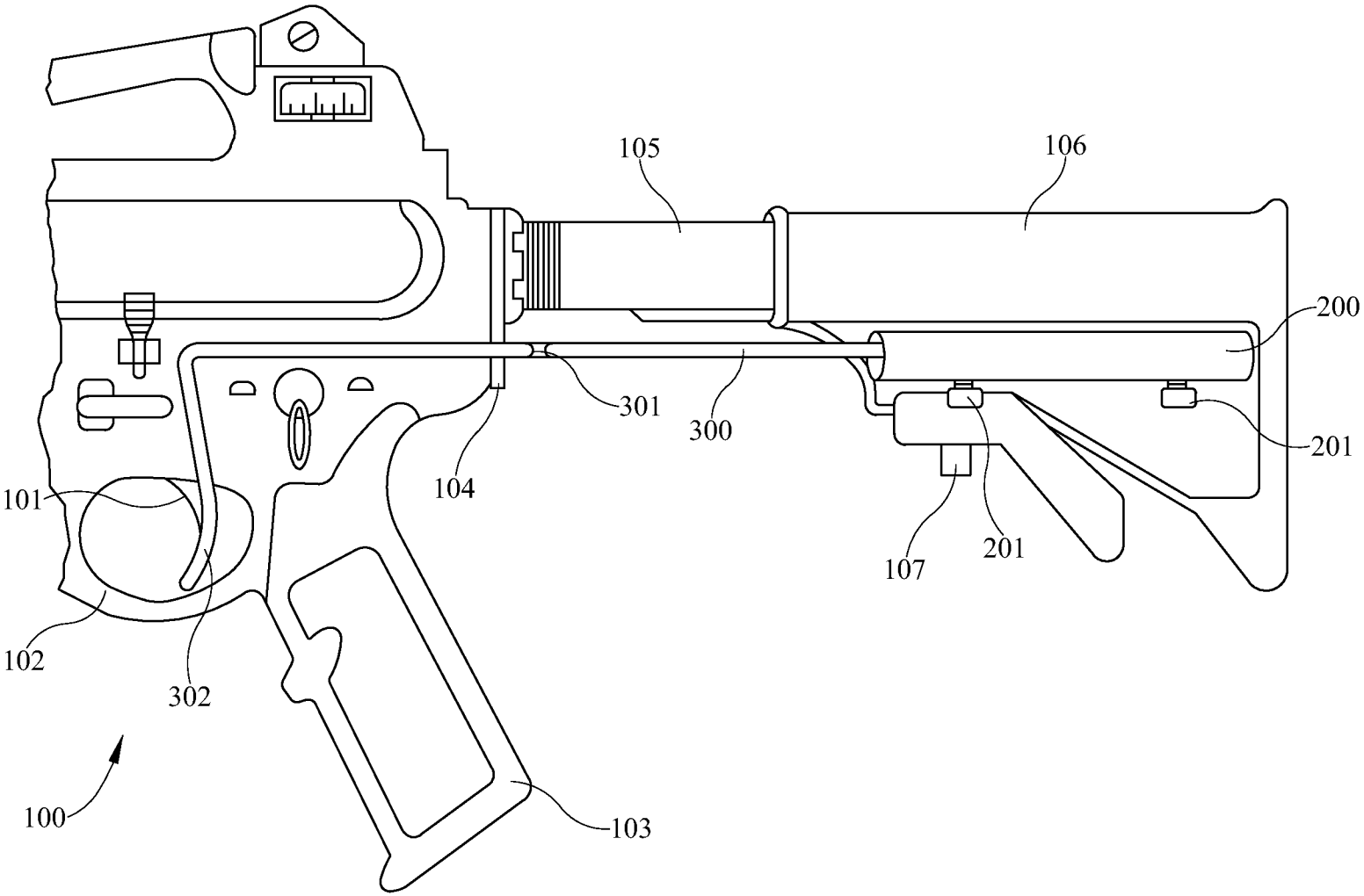
FIG. 2 is a magnified view of a portion of the firearm of FIG. 1 focusing on the removable device of FIG. 1.
Figure 3:
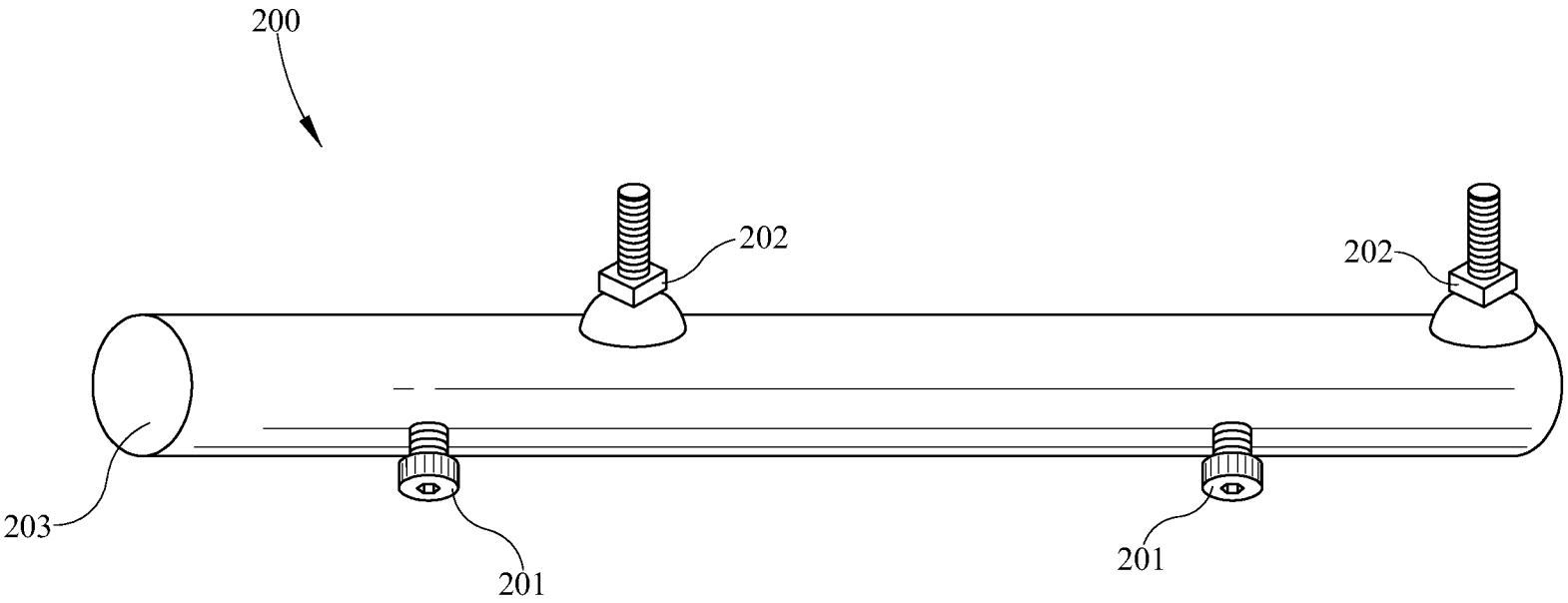
FIG. 3 is a perspective view of an embodiment of an anchor tube.
Figure 4:
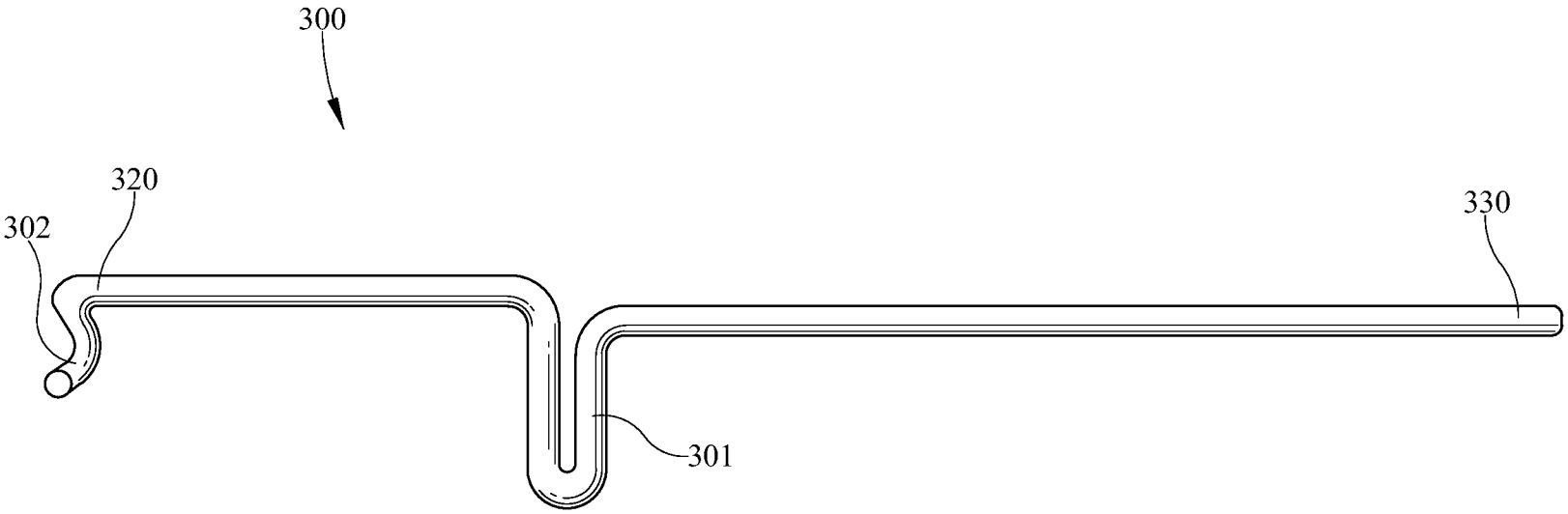
FIG. 4 is a perspective view of an embodiment of a connection rod.

Connection rod 300 may include a forward stop mechanism 301. Forward stop mechanism 301 may be interposed between connection rod first end 330 and connection rod second end 320, at or near first end 330 or second end 320, and/or configured to create a mechanical stop with another portion of firearm 100. In some embodiments, forward stop mechanism 301 may be interposed between first end 330 and finger hold 302, so that forward stop mechanism 301 is configured to create a mechanical stop with a portion of firearm 100 positioned rearward of trigger 101. For example, forward stop mechanism 301 may be configured to be positioned at or near a receiver plate 104 of firearm 100, as illustrated in FIG. 2. In this way, for example, as butt stock 106 slides forward relative to buffer tube 105, for example due to recoil from firing firearm 100, the relative forward sliding motion of butt stock 106 is halted by the contact of forward stop mechanism 301 with receiver plate 104. If connection rod 300 includes a central stem portion, as discussed above, forward stop mechanism 301 may be included in the central stem portion, although it is understood that this is not required.

In some embodiments, forward stop mechanism 301 may be positioned on connection rod 300 in such a way that finger hold 302 is allowed to slide forward enough to temporarily prevent a user's trigger finger from activating trigger 101, but the forward sliding motion is prevented from being excessive as excessive forward sliding could increase the amount of time required for the finger hold 302 to slide back and allow re-activation of trigger 101. It is understood that the positioning of forward stop mechanism will be dependent on the relevant dimensions of the firearm being used (e.g., buffer tube length, distance from receiver plate to trigger, etc.). For example, the embodiment depicted is intended for use with an AR-15 assault rifle, in which case the forward stop 301 may be approximately 4 inches from the finger hold 302. It is understood that any or all components described herein, including, but not limited to, butt stock 106, 406, anchor tube 200, 410, connection rod 300, finger hold 302, forward stop 301, and/or attachment mechanisms 201, 202 may be configured for a particular type of firearm 100 and/or may depend dimensionally on the type of firearm 100 used. For example, use with an M16 rifle may call for differently, but still predetermined, dimensioned components than would be used with an AR-15. It is understood that modifying the dimensions of the components is within the skill of a person of ordinary skill in the art.

While forward stop 301 is depicted as a substantially U-shaped bend integral with connection rod 300, it is understood that any of a variety of protrusions or extensions may be used to create forward stop 301. It is further understood that forward stop 301 may be a separate piece that may be mounted, attached, or connected to the connection rod 300 by any of a variety of attachment mechanisms (e.g., screw, bolt, snap, welded, etc.) depending on the geometry of the particular firearm being used. It is also understood that having a removably attachable forward stop 301 may facilitate on site modification and/or customization of the connection rod 300 and/or forward stop 301 for use with more than one specific type of firearm. Further still, it is understood that forward stop 301 may be made of any of a variety of materials and may be the same as or different than the material or materials used to construct connection rod 300.

In some embodiments, connection rod 300 may be approximately 9-15 inches in length, and, in some embodiments, between 11-13 inches in length. The length of the connection rod 300 may depend on the design of a specific firearm with which it is to be used. For example, a firearm having a longer distance between trigger 101 and receiver plate 104 may require a longer connection rod 300 than a firearm with a shorter such distance. Connection rod 300 may be any of a variety of thicknesses and/or diameters, although connection rod 300 may have a thickness less than or equal to the width of anchor cavity 203 to facilitate insertion and/or attachment of connection rod 300 to anchor tube 200. For example, it has been found that a thickness or diameter of about 0.25 inches for connection rod 300 is suitable. It is understood that this is merely an example and that connection rod 300 may have a different diameter or thickness and that the diameter or thickness of connection rod 300 may vary over the length of connection rod 300 and is not required to be uniform. Connection rod 300 may be made from any of a variety of materials, including, but not limited to, plastic, wood, rubber, synthetic material, metal such as, for example, steel, copper, aluminum, alloy, or any other metal or combination thereof, any other material, or any combination thereof. In some embodiments, the material used to construct connection rod 300 may be chosen based on strength and/or durability, as connection rod 300 may be subject to substantial forces quite often.

Figure 5A:
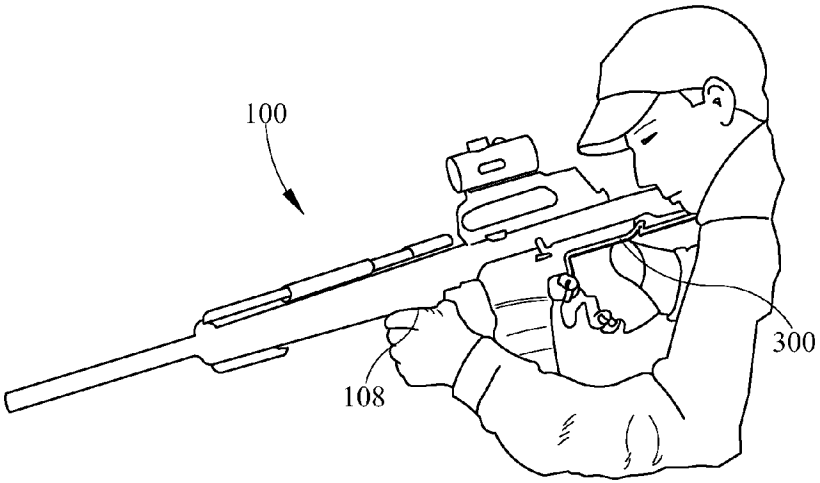
FIG. 5A is a side view depicting a user holding an embodiment of a firearm having an embodiment of a removable device.
Figure 5B:
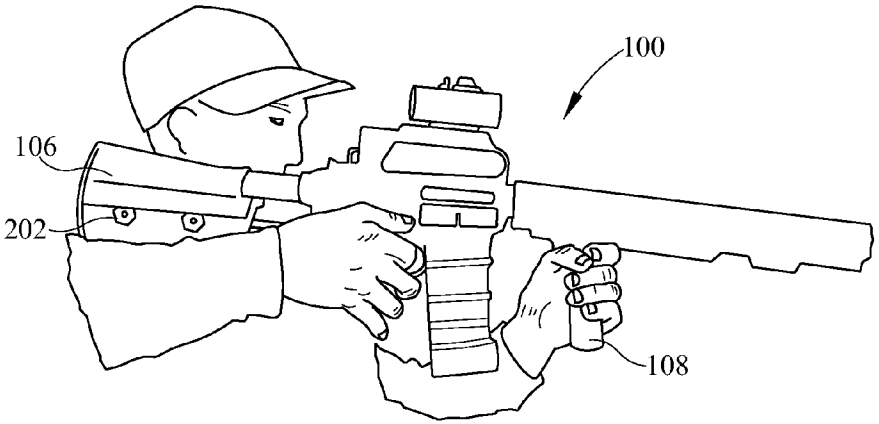
FIG. 5B is a side view of the user, firearm, and retrofit device of FIG. 5A from the opposite side as FIG. 5A.

Referring now to FIGS. 5A-5B, firearm 100 is shown as it may be held by a user, with the user positioned near a rearward portion of firearm 100 with the barrel of firearm 100 aimed forward or down range. The user's trigger finger of the trigger hand is looped through the trigger housing 102 to be adjacent trigger 101 and finger hold 302 (see FIG. 2). The user's non-trigger hand is placed on forward grip 108 and the user may apply forward (down range) force to the forward grip thereby applying a forward force to the body or housing of firearm 100, wherein the body or housing includes the forward grip 108 and the trigger 101. In this way, as butt stock 106 slides back and forth along buffer tube 105, anchor tube 200, connection rod 300, and finger hold 302 similarly slide back and forth. Finger hold 302 can therefore be made to repeatedly slide forward to remove a user's trigger finger from trigger 101 and slide backward to allow activation of trigger 101 by the user's trigger finger. In this way, the firing rate of firearm 100 may be increased by a bump firing or similar method.

Figure 6A:
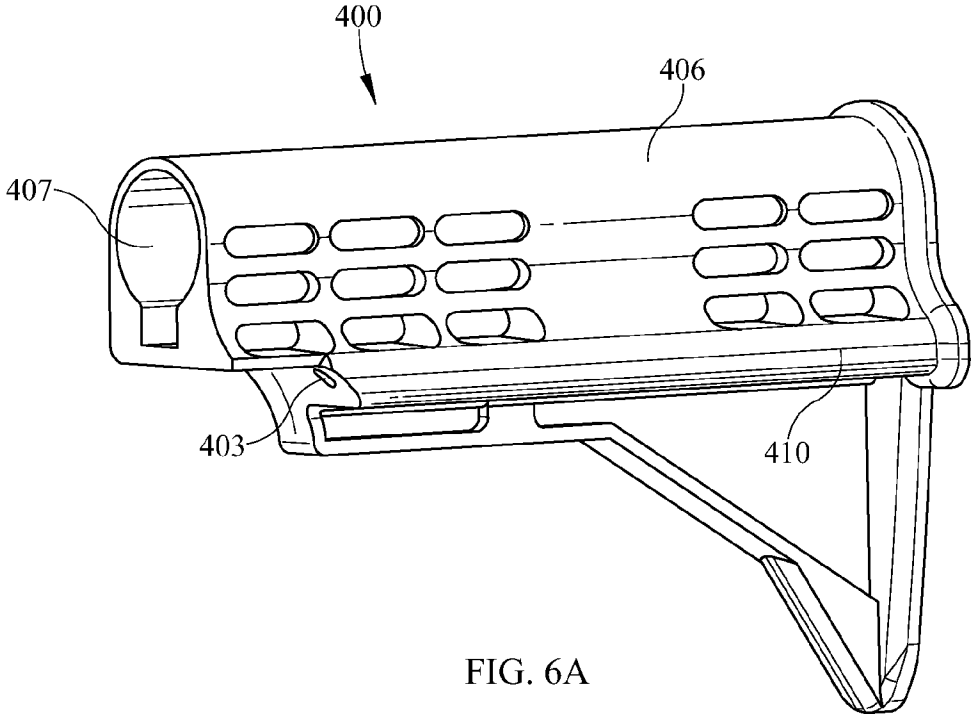
FIG. 6A is a perspective view of an embodiment of a butt stock and anchor tube of an embodiment of a removable device.
Figure 6B:
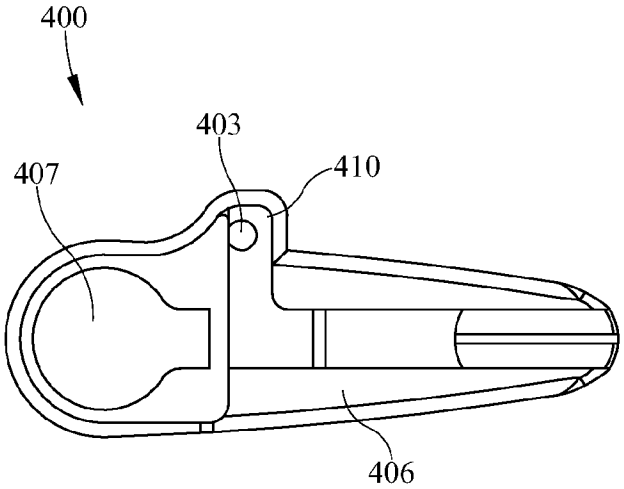
FIG. 6B is a front view of the butt stock and anchor of FIG. 6A.

Referring now to FIGS. 6A-6B, an embodiment of a butt stock and anchor tube unit 400 is shown having butt stock 406 and anchor tube 410. In this embodiment, instead of being removably attachable, butt stock 406 and anchor tube 410 are formed as one integral unit. Anchor tube 410 may have cavity 403 for accepting connection rod 300, which may function in much the same way as in an embodiment including butt stock 106 and anchor tube 200, as described above. Connection rod 300 may be configured for use with either anchor tube 200 and butt stock 106 or butt stock and anchor tube unit 400, or both. Anchor screws 201 may thus be used to attach connection rod 300 to anchor tube 410. Butt stock 406 may include a buffer tube receiving cavity 407 for, for example, receiving buffer tube 105 of firearm 100. Thus, embodiments including butt stock and anchor tube unit 400 may operate similarly to embodiments having butt stock 106 and (removable) anchor tube 200. Butt stock and anchor tube unit 400, in some embodiments, may be configured and/or formed as a single plastic unit (e.g., by plastic molding, if made of plastic, or by virtually any other manufacturing operation). Thus, butt stock and anchor tube unit 400 may be made, sold, installed, removed, and/or used as a single unit, if one so preferred. It is understood that any of a variety of materials may be used to construct or form butt stock 406, anchor tube 410, and/or butt stock and anchor tube unit 400, including, but not limited to, plastic, wood, rubber, synthetic material, metal such as, for example, steel, copper, aluminum, alloy, or any other metal or combination thereof, any other material, or any combination thereof.

In use, the firing rate of firearm 100 may be increased by, for example, removing butt stock 106 provided with firearm 100, affixing anchor tube 200 to butt stock 106 (or replacement butt stock) or replacing butt stock 106 with butt stock and anchor tube unit 400, affixing connection rod 300 to anchor tube 200 or anchor tube 410 such that finger hold 302 is positioned near trigger 101 and/or forward stop 301 is configured to form a mechanical stop with some portion of firearm 100 when the butt stock is in a forward position, such as described above. A user may activate the trigger 101 of firearm 100 to fire a round from firearm 100. The user may apply forward pressure to firearm 100 at a grip, such as forward grip 108, to cause relative motion between the finger hold 302 and the trigger 101. In this way, bump firing or a similar method can be achieved to increase the firing rate of firearm 100.

For example, a user may apply a forward (down range) force, for example, approximately 5-10 lbs., to forward grip 108 using his or her non-firing hand. Holding the rear grip 103 with his or her firing hand, the user may place a finger through trigger housing 102 and rest his or her finger on the finger hold 302. In this position, it may be better if the user's trigger finger does not touch the trigger 101 until the forward force is applied. Once the proper degree of forward or down range force is applied by the forward or non-trigger hand to the forward grip 108, this forward force will cause firearm 100 (with butt stock 106, 406, and attached anchor tube 200, 410 and connection rod 300) to move forward and the user's finger in trigger housing 102 will be caused to contact trigger 101 causing firearm 100 to fire a single round of ammunition. The natural recoil of the firearm 100 caused by the firing of the single round will cause backward motion of firearm 100 relative to butt stock 106, 406, anchor tube 200, 410, and connection rod 300, due to the restrained backward motion of butt stock 106, 406 against the user's shoulder. During this relative motion, forward stop 301 contacts receiver plate 104 restraining the firearm 100 and/or buffer tube 105 from moving backward into butt stock 106, 406. This relative motion also causes the connection rod 300 and/or finger hold 302 to move forward relative to the user's finger thus removing the user's finger from trigger 101. The next round, and/or subsequent rounds, are placed into the firing chamber by operation of firearm 100 and the process may be repeated as long as the user applies forward pressure to firearm 100 and ammunition is fired from firearm 100.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The foregoing description of several methods and embodiments have been presented for purposes of illustration. It is not intended to be exhaustive or to limit the precise steps and/or forms disclosed, and obviously many modifications and variations are possible in light of the above teaching. It is intended that the scope and all equivalents be defined by the claims appended hereto.

What is claimed is:

1. A removable device for increasing the firing rate of a firearm, comprising:

a connection rod removably attachable to an anchor tube and slidably retained in said anchor tube;

said anchor tube removably attachable to a butt stock of said firearm;

wherein said butt stock slidably engages said firearm, said butt stock reciprocatingly slidable between a forward position and a rearward position;

wherein said connection rod is removably attachable to said anchor tube at a first end of said connection rod, said connection rod having a finger hold configured to be adjacent a trigger of said firearm and reciprocating relative to said trigger;

said finger hold reciprocatable to allow reciprocating activation and de-activation of said trigger of said firearm by a trigger finger, said activation allowing said firearm to fire one or more rounds from said firearm when said connection rod and said anchor tube are attached to said butt stock and said butt stock is in said rearward position; and said de-activation of said trigger allowing said finger hold to be positioned forward of said trigger allowing removal of said trigger finger from said trigger when said connection rod and said anchor tube are attached to said butt stock and said butt stock is in said forward position.

2. The removable device of claim 1 wherein said connection rod includes a forward stop interposed between said first end of said connection rod and an oppositely disposed second end of said connection rod, said forward stop configured to form a mechanical stop with said housing of said firearm when said butt stock is in said forward position.

3. The removable device of claim 2 wherein said forward stop is interposed between said first end of said connection rod and said finger hold.

4. The removable device of claim 3 wherein said forward stop is configured to form said mechanical stop with a receiver plate of said firearm.

5. The removable device of claim 3 wherein said forward stop is removably attachable to said connection rod at one or more locations on said connection rod.

6. The removable device of claim 1 wherein said finger hold is removably attachable to said connection rod.

7. The removable device of claim 1 wherein said anchor tube is cylindrical having an annular anchor cavity for receiving said connection rod, said annular anchor cavity having a substantially continuous diameter.

8. The removable device of claim 1 wherein said connection rod reciprocates substantially along an axis defined by a central longitudinal axis of the firearm.

9. The removable device of claim 1 wherein said connection rod has a longitudinally extending central stem having a forward stop and said finger hold is defined by a curved finger support depending from said longitudinally extending central stem.

10. The removable device of claim 9 wherein said finger support is positioned adjacent said trigger of said firearm.

11. A device for increasing the firing rate of a firearm, comprising:

a butt stock slidably engageable with a buffer tube of said fire arm, said butt stock slidable between a forward position and a rearward position;

an anchor tube rigidly affixed to said butt stock to form a butt stock and anchor tube unit;

a connection rod removably attachable to said anchor tube at a first end of said connection rod;

said connection rod having a finger hold disposed at a predetermined distance from said first end of said connection rod, said predetermined distance determined by the location of a trigger of said firearm;

said connection rod having a second end disposed opposite said first end of said connection rod;

said connection rod having a forward stop interposed between said first end of said connection rod and said second end of said connection rod, said forward stop configured to form a mechanical stop formed by contact with a portion of said firearm when said butt stock is in said forward position, said forward stop reciprocatable relative to said portion of said firearm; and said finger hold adjacent said trigger of said firearm, said finger hold configured to remove a user's finger from said trigger when said butt stock is in said forward position and configured to allow activation of said trigger of said firearm to fire one or more rounds from said firearm when said butt stock is in said rearward position.

12. The device of claim 11 wherein said forward stop is removably attachable to said connection rod at one or more locations on said connection rod.

13. The device of claim 11 wherein said finger hold is removably attachable to said connection rod.

14. A device for increasing the firing rate of a semi-automatic rifle, comprising:

a slidable butt stock, an anchor tube, and a connection rod;

said slidable butt stock longitudinally slidably reciprocatable along a buffer tube of said semi-automatic rifle;

said anchor tube attached to an exterior side of said butt stock, said anchor tube extending longitudinally substantially parallel to said buffer tube;

said anchor tube having an anchor cavity configured to accept a first end of said connection rod;

said connection rod removably attachable to said anchor tube and at least partially insertable into said anchor cavity, said connection rod extending longitudinally substantially parallel to said anchor tube;

said connection rod and said anchor tube reciprocatable with said butt stock;

said connection rod having a finger hold and a forward stop located on said connection rod, such that when said connection rod is in a forward position said finger hold is positioned forward of a trigger of said semi-automatic rifle to restrict a trigger finger from activating said trigger; and said finger hold configured so that it is positioned rearward of said trigger when said connection rod is in a rearward position to allow activation of said trigger by said trigger finger.

15. The device of claim 14 wherein said forward stop is interposed between said first end of said connection rod and said finger hold.

16. The device of claim 14 wherein said forward stop is configured to form said mechanical stop with a receiver plate of said semi-automatic rifle.

17. The device of claim 16 wherein said mechanical stop is formed by contact between said forward stop and a receiver plate of said semi-automatic rifle.

18. The device of claim 14 wherein said forward stop is removably attachable to said connection rod at one or more locations on said connection rod.

19. The device of claim 14 wherein said finger hold is removably attachable to said connection rod.

* * * * *